US005668533A

United States Patent [19]

Jackson, Jr. et al.

[11] Patent Number: 5,668,533

[45] Date of Patent: Sep. 16, 1997

[54] HIGH SECURITY BALANCED-TYPE, MAGNETICALLY-ACTUATED PROXIMITY SWITCH SYSTEM

[75] Inventors: John T. Jackson, Jr., Reno; Robert C. Cook, Sparks; Robert C. Hunt, Reno, all of Nev.

[73] Assignee: Securitron Magnalock Corporation, Sparks, Nev.

[21] Appl. No.: 474,098

[22] Filed: Jun. 7, 1995

[51] Int. Cl.[6] ..... G08B 13/08

[52] U.S. Cl. ..... 340/547; 335/205; 340/686

[58] Field of Search ..... 340/547, 686; 335/205–207

[56] References Cited

U.S. PATENT DOCUMENTS

| | | | |
|---|---|---|---|
| Re. 32,654 | 4/1988 | Jackson, Jr. | 310/156 |
| 2,912,540 | 11/1959 | Sawicki | 335/161 |
| 3,305,805 | 2/1967 | Tann | 335/153 |
| 3,668,576 | 6/1972 | Krizman et al. | 335/153 |
| 3,896,427 | 7/1975 | Campman | 340/686 X |
| 3,974,469 | 8/1976 | Nicholls | 335/153 |
| 4,186,362 | 1/1980 | Kondo et al. | 335/205 |
| 4,210,888 | 7/1980 | Holce | 335/207 |
| 4,210,889 | 7/1980 | Holce | 335/207 |

(List continued on next page.)

FOREIGN PATENT DOCUMENTS

| | | | |
|---|---|---|---|
| 2347728 | 11/1977 | France | 340/547 |
| 368664 | 4/1973 | U.S.S.R. | 335/205 |
| 1112425 | 9/1984 | U.S.S.R. | 335/205 |
| 1417067 | 8/1988 | U.S.S.R. | 335/205 |

OTHER PUBLICATIONS

Sentrol Security and Life Safety Sensor New, vol. 1, No. 2, Winter 1994 (2 pages).

Sentrol, Inc. 2700 Series, pp. 30–32 (3 pages).

"Principles of Direct–Current Machines"; A.S. Langsdorf, M.M.E., Electrical Engineering Texts, 1940, p. 75 (2 pages).

"High Security BMS Contacts"; Flair Product Information Bulletin, MSS–100–17, (1 page).

"Anti–Defeat High Security Contacts"; AMSECO, ADM–30/31 (2 pages).

*Primary Examiner*—Thomas Mullen

*Attorney, Agent, or Firm*—Oppenheimer Poms Smith

[57] ABSTRACT

A magnetically-actuated, proximity switch system for use in physical security monitoring systems, machinery control systems and the like, including a stationary assembly and an actuator assembly moveable relative thereto. The stationary assembly includes at least two electrically-interconnected magnetic reed switches and at least two interacting permanent biasing magnets disposed in a predetermined physical relationship. The magnets are arranged to have opposing polarity orientations which produce a resultant interactive magnetic field. Each reed switch is biased in a magnetically actuated state by its orientation and position within that field. The actuator assembly in turn includes at least two permanent actuating magnets arranged to produce a number of apparent magnetic poles corresponding to the number of apparent (or consequent) poles produced by the permanent biasing magnets and in opposition thereto. Thereby, the permanent magnet resultant interactive field is altered, thereby overcoming the effect of the permanent biasing magnets when the stationary assembly and the actuator assembly are in a predetermined relative physical relationship. The number of apparent poles is odd, and they are interactive so that the stationary assembly advantageously cannot be deceived or defeated using only a single permanent external magnet. A ferrous metal slug can be provided between the two bias magnets to aid in adjusting the positioning of the components to yield the desired performance and to magnetically short out a powerful individual magnet that could be eternally positioned in the center of the bias magnets in an attempt to defeat the device. A U-shaped ferrous metal shield can be used as an outer enclosure for the switch module.

65 Claims, 8 Drawing Sheets

U.S. PATENT DOCUMENTS

| | | | |
|---|---|---|---|
| 4,213,110 | 7/1980 | Holce | 335/207 |
| 4,271,763 | 6/1981 | Berger | 335/207 X |
| 4,339,747 | 7/1982 | Maybee | 340/547 |
| 4,445,061 | 4/1984 | Jackson, Jr. | 310/156 |
| 4,544,903 | 10/1985 | Grant | 335/205 |
| 4,945,340 | 7/1990 | Brill | 340/547 |
| 5,057,807 | 10/1991 | Longly et al. | 335/207 |
| 5,128,641 | 7/1992 | Posey | 335/151 |
| 5,233,322 | 8/1993 | Posey | 335/151 |
| 5,233,323 | 8/1993 | Burkett et al. | 335/207 |
| 5,293,523 | 3/1994 | Posey | 335/205 |

HIGH SECURITY BALANCED-TYPE, MAGNETICALLY-ACTUATED PROXIMITY SWITCH SYSTEM

BACKGROUND OF THE INVENTION

The present invention relates to magnetically-actuated proximity switch systems for detecting and monitoring access by the opening or closing of panels, windows, doors or the like and as part of an electrically-monitored physical security system or machinery control system.

Magnetically-actuated proximity switches are often used in physical security systems and in machinery control systems and typically employ one or more reed switches in conjunction with one or more permanent actuating magnets. Examples of magnetic switches are shown, for example, in U.S. Pat. Nos. 4,339,747 (Maybee); 5,057,807 (Longly et at.); 5,128,641 (Krizman et at.); 5,233,322 (Posey); 5,293,523 (Posey); and 3,305,805 (Tann). (These and all other patents and publications mentioned anywhere in this disclosure are hereby incorporated by reference in their entireties.) The magnetically-actuated reed switch is typically mounted in or about the frame surrounding a doorway, window or access panel and has conductors leading out from it to the security or machinery monitoring control unit. The door or cover can be a safety guard on an industrial machine (such as a hydraulic press) with a safety interlock switch which detects whether the guard is closed and the machine can thereby be safely operated. The switch also has one or more permanent actuating magnets mounted in or about the door, window or access panel itself in predetermined positions so that movement away from or to close proximity of the predetermined position to the reed switch actuates the reed switch. This produces a signal received by the security or machinery monitoring control unit.

Previously, biasing magnets have been placed close to the reed switch so that the permanent biasing magnets field is strongly coupled to the reed switch thereby increasing the sensitivity of the reed to the external magnetic field(s). This permits the use of smaller and less expensive actuating magnets. Various means for making this increased sensitivity adjustable are known, and one example is by varying the position of the permanent biasing magnet along an imaginary axis parallel to the axis of polarity of the permanent biasing magnet. This is shown by U.S. Pat. No. 4,213,110 (Holce) ('110).

Some of the biasing means in the prior art are used in combinations to make high security switches, sometimes known as "balanced" switches, so that they are resistant to manipulation or deception by the use of foreign magnetic fields. To explain, with a standard magnetic switch mounted on a door, for example, it is easy for an intruder to affix an external magnet near the switch. He can then open the door without the switch changing state and therefore without activating the building alarm system. If a powerful external magnet is employed, it can even be mounted on the opposite side of the door frame and still defeat the switch. As an example of a solution to this problem, the '110 patent shows a means for biasing a reed switch and is used in combination to produce a balanced high-security switch, as shown by U.S. Pat. No. 4,210,889 (Holce) ('889). The adjusting mechanisms in the '889 patent are made during manufacture thereof and therefore do not require any screw adjustment mechanism.

The factory adjustments of the prior art switches required during their manufacture result from the material and physical tolerances being the same order of magnitude as the mechanism's operational parameters. Consequently, each switch must be adjusted during the manufacturing process to compensate for these variations. Quality control of the component properties needed to eliminate these adjustments is not economically profitable since dimensional tolerances of the components would need to be very small. Additionally, the magnetic properties vary such that the components would have to be screened.

It is further known in the art that small permanent biasing magnets can be strongly coupled individually to respective reed switches and disposed in predetermined locations so that in combination a balanced high security switch is formed. However, it is deskable that these individual permanent biasing magnets not interact. As arranged the magnetic fields of the individual bias magnets tend to cancel each other's respective magnetic fields. Thus, in the prior art if the biasing magnets are too close together the fields tended to cancel out. Furthermore, the prior magnetically-actuated proximity switches of the balanced type require many complicated parts including extra magnetic wires and bending the ends of the reeds. They require time consuming factory or field adjustments. They are more sensitive by design than a bare reed to extraneous electromagnetic fields and other electromagnetic devices such that false triggerings may occur. Furthermore, they are highly susceptible, whether singly or in combination, to demagnetization or random magnetic pole reorientation by high coercive permanent magnets brought into close proximity to their biased reed switch.

Examples of other known high security switches are shown in U.S. Pat. Nos. 2,912,540 (Sawicki); 3,974,469 (Nicholls); 4,210,889 (Holce); 4,945,340 (Brill); 4,544,903 (Grant); and 5,233,323 (Burkett et at.) A further example of a prior art high security switch is the "MSS-100-17 High Security BMS Contacts" available from Flair Electronics, Inc. of Glendora, Calif. Another example is the powered high security switch available from Sentrol, Inc. of Portland, Oreg., called the "2900 Series High Security Magnet Contact" system, and as described in the "Sentrol Security and Life Safety Sensor News, " Vol. 1, No. 2, Winter 1994, and the "2700 Series High Security Anodized Alloy Housing With Armor Cable" system. The Sentrol systems apparently have little or no control over the actuation range. To obtain a large actuation distance the Sentrol systems would need to use a very large actuator magnet since the static portions of their switches apparently are not adjustable.

A still farther example is the ADM-30/31 high security switch available from AMSECO of Carson, Calif., and as described in its two page literature entitled "ADM-30/31 Anti-Defeat High Security Contacts." It is a simple and inexpensive design using two biased reeds and three magnets in the actuator. Although the device can be termed "defeat resistant" because of the multiple reed/multiple magnet construction, it can be relatively easily actuated by a single magnet placed at either end thereof. Thus, it might more appropriately be termed a "medium" security switch. An unusual feature of the AMSECO design is that the actuator can activate the reeds in a 360 degree circle around the module holding the reeds. As will be made clearer later, this makes it easy to defeat the AMSECO switch by employing a second AMSEGO actuator.

Inasmuch as the reason for development of high security balanced-type switches is to oppose as much as possible any attempt to defeat the switch by suppressing its alarm signal while the door or other barrier is opened, it is important to consider the security shortcomings of existing designs. While many of them are quite effective at avoiding defeat from a single external magnet, all of them are subject to defeat by someone who has obtained a second actuator. The second actuator is merely placed at the same distance from the switch module as the standard actuator but at a different angle and the switch is defeated.

Another method of defeating existing switches is simply by physically removing the device from its substrate. The switch module and actuator are then maintained in their physical relationship to each other, so no alarm signal is sent. However, since they have been removed from the door, it may be opened. This problem has been partially addressed in some designs, by creating a separate alarm signal if the switch module is dismounted through a tamper detect means, but several weaknesses remain as discussed now. Some prior tamper detect means on the switch module have been obvious to an intruder and no tamper detect means has ever been applied to the actuator. This is because the actuator mounts on a door, window or moving panel to which is prohibitively costly to run wires. All wiring is to the switch module which mounts on a fixed frame to which wires can be easily run. Therefore existing designs can be defeated by removing the actuator from the door while maintaining its distance from the switch module and then rotating it to a position with respect to the switch module that allows the door to be opened without the creation of an alarm signal.

An example of a prior art tamper switch arrangement which is available from Sentrol, Inc. includes a reed switch located on the bottom of the Sentrol switch module (the mounting surface) which is isolated by a steel plate from the rest of the switch module and a plastic plaque in the center of which is mounted a small magnet. The plaque is mounted on the door and the switch assembly is mounted on top. If the switch is ripped off of the plaque, the reed switch in the bottom of the switch module is separated from the magnet in the plaque and an alarm is actuated. However, no alarm results if the switch and plaque are both ripped off. Thus, a prior art solution has been to provide attachment screws in the plaque. Then if the switch is tom off, the screws which are relatively inaccessible keep the plaque in place. This can be defeated though by the intruder running a saw through the plaque. Additionally, the plaque is about one-eighth inch thick and it can therefore be readily observed that the switch module includes a defense against tampering.

Another example of a prior art technique for tamper proofing a high security switch module is found in the Flair Electronics product previously mentioned. The switch module of that product includes a removable cover. The installer removes the cover and then mounts the switch module by driving screws through the base of the switch module into the substrate. When the cover is replaced, the screw heads are afforded some protection against removal. A spring-loaded mechanical switch is located within the switch module, and it triggers an alarm signal if the switch module cover is subsequently removed by someone seeking to access the screw heads to remove the screws. This has an advantage over the Sentrol design in that the presence of a tamper feature is not noticeable but the tamper alarm will not sound if the switch module is removed completely from the substrate through the use of a saw, for example, which is the same weakness found in the Sentrol design.

Accordingly, there is a need for an improved magnetically-actuated, high security balanced-type proximity switch system which is substantially more difficult to actuate with an external magnetic field, which particularly includes effective defenses against defeat by a second actuator, which includes effective defenses against defeat by removal of either the switch module or actuator from their respective substrates, which maintains sensitivity to permanent actuating magnetic fields, which does not require extensive manufacturing or field adjustments, which is not susceptible to demagnetization by external high-coercivity permanent magnets, which has fewer parts, which has an adjustable actuation range, and which performs identically on steel doors as on wood or aluminum doors.

SUMMARY OF THE INVENTION

Directed to remedying these problems in the prior art, an improved proximity switch system is herein disclosed. This switch system includes (1) a switching assembly attachable to a frame about a window, door or other opening and (2) an actuator assembly attachable to a door, window or other barrier or cover movable relative to the opening and including at least two actuating magnets. In the switching assembly are a plurality of permanent, high coercivity biasing magnets arranged in a row with their magnetic axes alternating and coincident with an imaginary line connecting their centers. These magnets are mechanically affixed in position so that the repulsive forces acting between them cannot alter their fixed locations. This thereby creates a number of "apparent" or "consequent" magnetic poles in a field which is interactive such that interference with the field of one of the magnets affects all of them. (The terms "apparent pole" or "consequent pole" are used in this disclosure where two (or more) magnets are arranged so that at least one pair of like poles is in opposition thereby giving rise to the appearance of an odd number of poles. (See, for example, Alexander S. Langsdorf, "Principles of Direct-Current Machines," 1940, page 75)). A plurality of reed switches disposed in predetermined locations within that field are magnetically switched then when the actuator assembly is sufficiently removed and are released when the actuating magnets are moved to a predetermined range or distance relative thereto. The external fields of the actuating magnets act to sufficiently cancel the fields within the switch module, thereby releasing the reeds.

Thus, when the door (window or the like) is wide open, the reeds are both magnetically switched and the output of the device is said to be in the "alarm condition." Then when the door is fully closed, both reeds release and the device is said to be in the "Secure condition." The "actuation distances" represent ranges wherein the switch will be actuated and thereby placed in the secure condition. When the door is fully closed, it is preferred that the distance between the switch module and the actuator magnets will be the midpoint of this actuation distance range. The width of the actuation range can advantageously be controlled by the system design. The range is determined and adjusted by the relative position of the reed switches to the bias magnets.

Another characteristic of the present design is that pole orientation in both the switch module and actuator of the magnets can be reversed so that two different versions of each can be easily manufactured. The actuator from one version will only work with that version's switch module with the same being true of the other version. This improves defeat resistance as someone attempting to defeat a device with a second actuator has a 50% chance of being wrong.

Another embodiment of the invention is a tamper-proof mounting of a balancedtype magnetically-actuated proximity switch system to an outswinging door or other barrier and its surrounding frame. An actuator magnet pack is secured to the outswinging barrier with elongate (screw) fasteners extending in a first (horizontal) direction. A switch module is then secured to the surrounding frame with elongate (screw) fasteners extending in a second (vertical) direction perpendicular to the first. This perpendicular relationship helps prevent tamper. The adjacent-mounted switch module blocks tamper access to the screws thereby tamper-proof securing the magnet pack in position. That is, the axes of the magnet pack screws pass through the switch module and the magnet pack and switch module are separated by a small distance insufficient to provide access to remove the magnet pack screws. A cable operatively interconnecting the magnetically-actuable switch(es) of the switch module to an alarm system extends out the rear face of the switch module into an opening formed in the adjacent frame. The plunger end of a spring-biased tamper switch housed in the switch module is adjacent to and accessible through an opening in the rear face. The plunger end is flush with or recessed slightly in from the plane of the rear face. A screw or other similar element is secured into the frame with its head protruding out therefrom into the opening and biasing against the plunger end. The fact that the screw protrudes into the opening enhances defeat resistance. Should a potential intruder saw or cut through the screw to remove the switch module the plunger end would no longer be. biased and the alarm system would be actuated.

Other objects and advantages of the present invention will become more apparent to those persons having ordinary skill in the art to which the present invention pertains from the foregoing description taken in conjunction with accompanying drawings.

DETAILED DESCRIPTION OF PREFERRED EMBODIMENTS OF THE INVENTION

Figure 1:
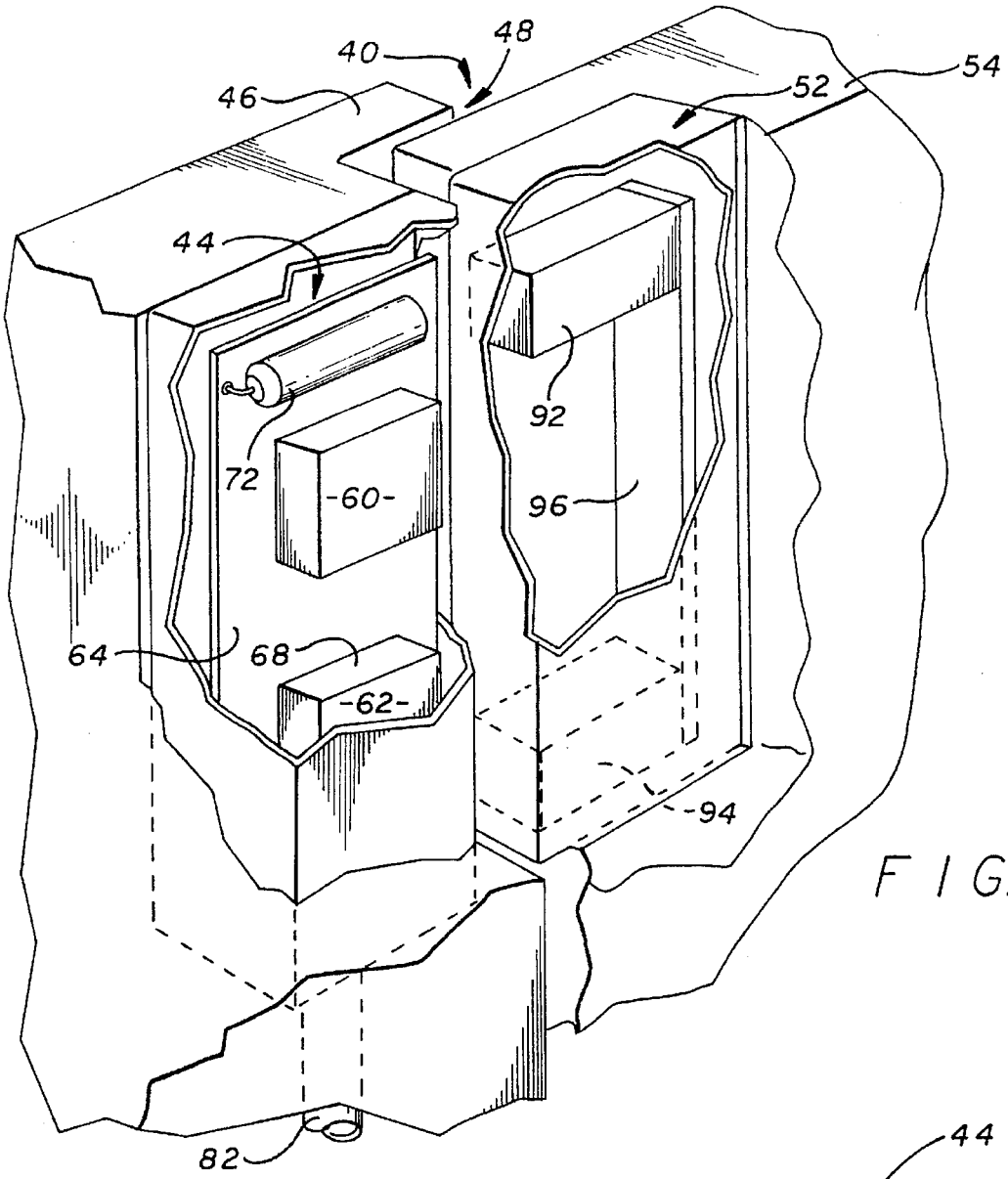
FIG. 1 is a perspective view of a switching system of the present invention showing the door, window or the like in a closed position, and with portions of the system broken away to show internal components.

A switching system of the present invention is shown in FIG. 1 generally at 40. System 40 includes a stationary switch assembly shown generally at 44 and mounted to the frame 46 of a door, window or other opening shown generally at 48 (hereinafter "opening") and an actuator assembly shown generally at 52 and mounted to a door, window or other barrier or cover 54 (hereinafter "cover") for that opening. The switch assembly 44 and the actuator assembly 52 are positioned relative to the opening 48 and relative to one another such that with the cover 54 in a closed position the actuator assembly magnetically affects the switch assembly due to its close proximity thereto and with the cover open, the assemblies are spaced and the magnetic effect is diminished or not present. This can be understood by comparing FIGS. 4, 5 and 6.

Figure 2:
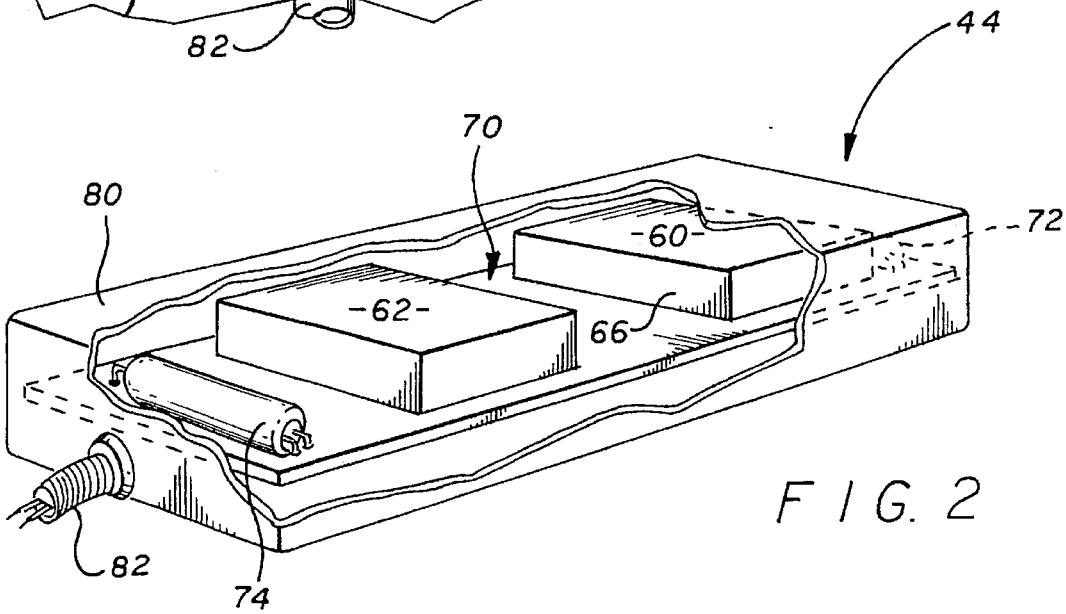
FIG. 2 is a perspective view of the stationary switch assembly of the system of FIG. 1, shown in isolation and with portions thereof broken away for illustrative purposes.
Figure 4:
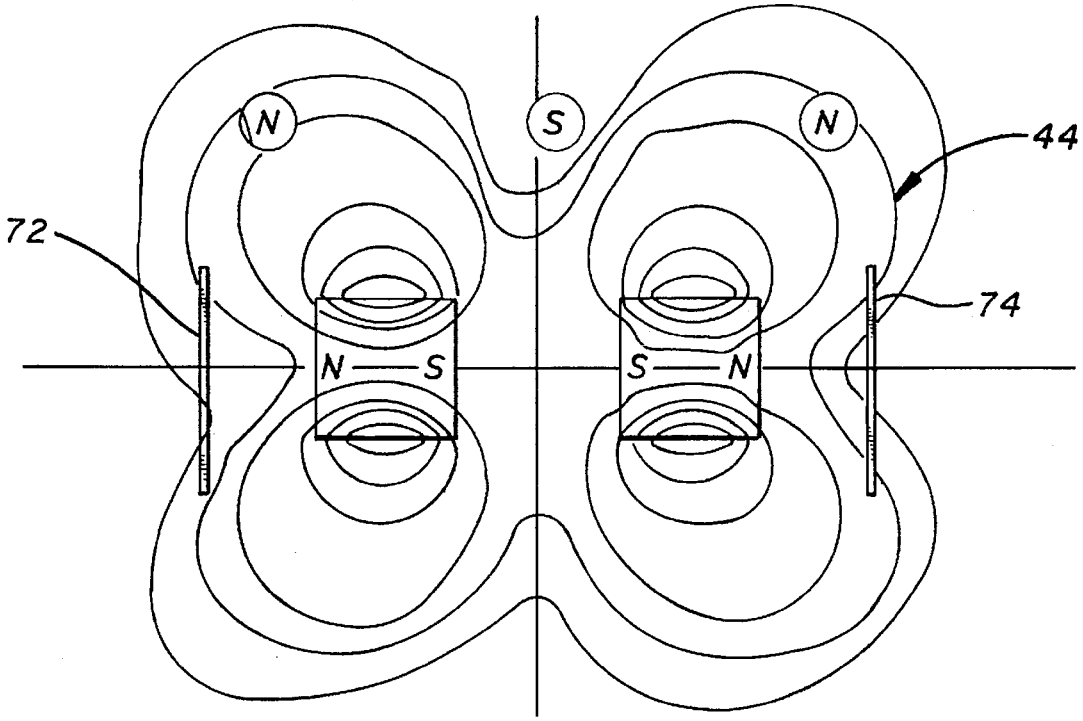
FIG. 4 is a magnetic field plot of the system of FIG. 1, with the actuator assembly in a fully open position.
Figure 5:
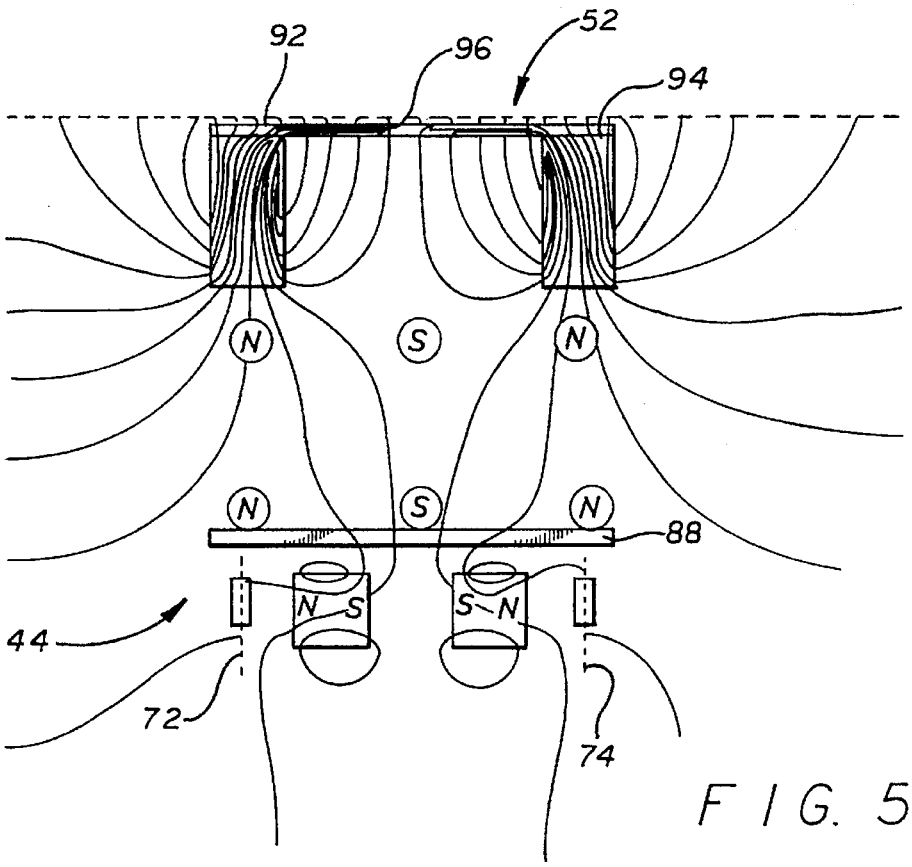
FIG. 5 is a magnetic field plot, similar to that of FIG. 4, with the actuator assembly in proximity to the stationary switch assembly.
Figure 6:
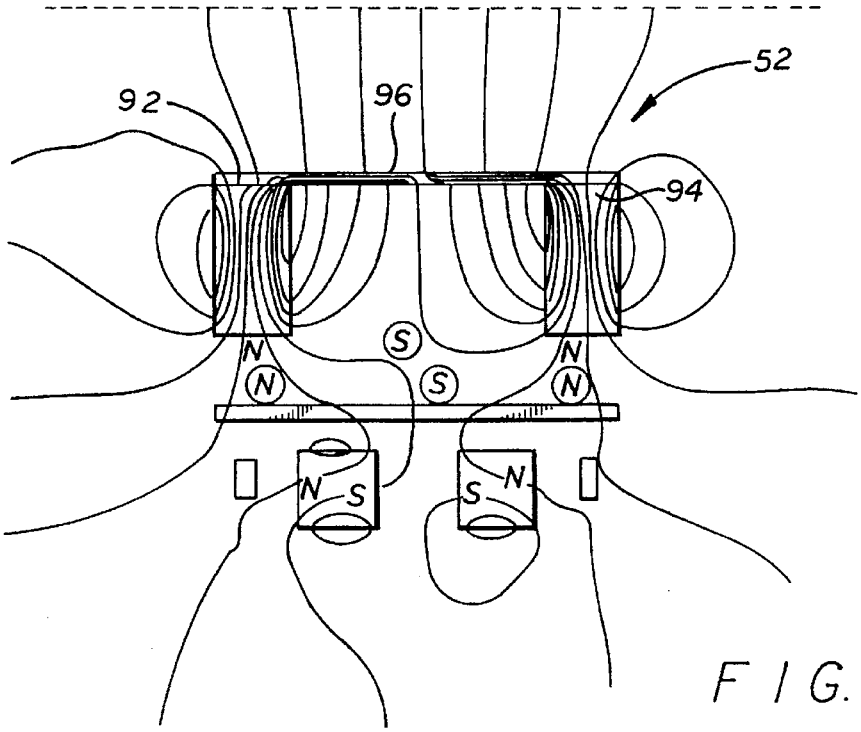
FIG. 6 is a magnetic field plot, similar to that of FIGS. 4 and 5, with the actuator assembly in a closed position relative to the stationary switch assembly.

The switch assembly 44 as shown in FIGS. 1 and 2 includes first and second switch permanent, high coercivity (on the order of 2,000 to 30,000 Oersteds) magnets 60, 62 positioned with their poles axially aligned and a pair of like poles facing each other thereby creating a resultant interactive magnet switch field, that is, interlocking fields are produced. That is, the magnets 60, 62 are arranged in a row with their magnetic axes alternating and coincident with an imaginary line connecting their centers. This field produces a plurality of switch field apparent poles, as shown in FIGS. 4–6 by the circled letters. The number of switch field poles is an odd number and thereby the system 40 cannot be deceived using only a single permanent foreign magnet, because it has an even number of poles. The magnets 60, 62 are affixed to a mounting plate 64 to keep them fixed relative to one another against their repulsive force. Both of the magnets have substantially the same length of about one-half inch and their lengths are equivalent to the lengths of the diameters of their faces 66, 68. The gap shown generally at 70 between their adjacent ends is also equivalent to the individual magnet length.

Figure 3:
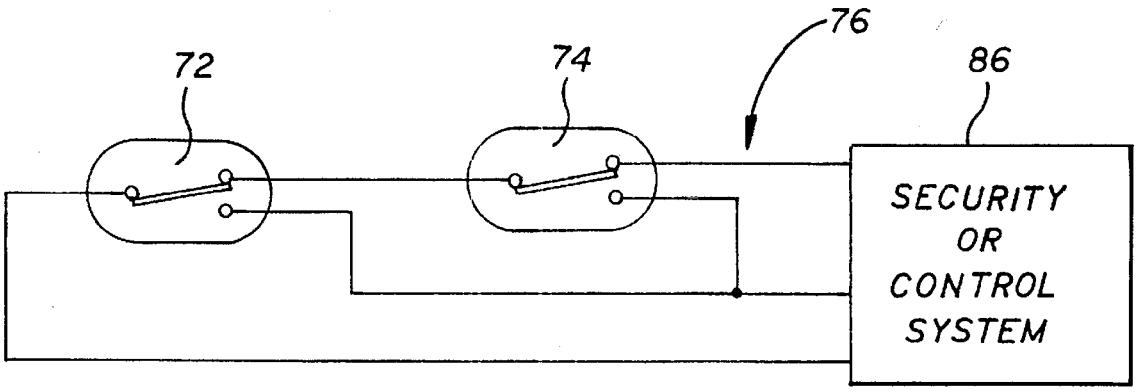
FIG. 3 is an electrical schematic of the system of FIG. 1, shown in an unactuated condition.

Also mounted to the molting plate 64 are first and second reed switches 72, 74 positioned on opposite ends of the respective first and second switch magnets 60, 62 and generally perpendicular to the axial alignment of the magnets. Reed switches 72, 74 can be "Form C" reeds such as are available from the Hamlin, Aleph, Hermetic and Gunther companies. The switches 72, 74 are electrically connected together in a circuit 76 with the wires passing out of the housing 80 in a cable 82 to a security or control unit or system shown generically at 86 in FIG. 3. The switches 72, 74 are preferably in a single-pole double-throw switching arrangement.

Due to the influence of the interactive field and with the cover 54 in an open position, the switches 72, 74 are both magnetically switched and the control unit 86 is reading an alarm condition. Then with the cover 54 fully dosed, both switches 72, 74 are released due to the influence of the actuator assembly thereon and the control unit 86 is reading a secure condition. Element 88 shown in FIGS. 5 and 6 is simply a computer reference line, used to produce these magnetic field plots.

Numerous configurations of the magnets of the actuator assembly 52 are possible. One preferred configuration includes first and second actuator permanent magnets 92, 94 fixed parallel to and spaced from one another and with their north pole ends pointing in the same direction, as shown in FIG. 1 for example. A bar 96 magnetically connects the ends of the magnets 92, 94 away from the switch assembly 44 when the cover 54 is in a closed position. The actuator magnets 92, 94 may have similar or higher coercivity to the switch magnets 60, 62. Higher-coercivity actuator magnets will generally permit a larger actuation distance for the same unit size actuator. The actuator magnets 92, 94 are arranged to produce a plurality of actuator field apparent poles, and preferably three poles as shown in FIGS. 4, 5 and 6, The number of the actuator field apparent poles is the same as the number of switch field apparent poles and in opposition thereto as shown in FIG. 5, such that the magnetic fields cancel to release the reed switches, as shown in FIG. 6. Then when the cover 54 is closed, the actuator field apparent poles alter the switch field thereby overcoming the magnetic switching effect of the switch field on the switches 72, 74. In other words, the two switches 72, 74 are thereby released and the control unit 86 is reading a secure condition.

Figure 7:
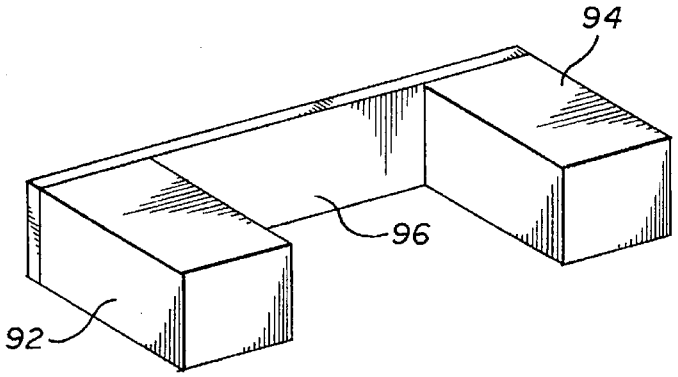
FIG. 7 is a perspective view of the magnet arrangement of the actuator assembly of the system of FIG. 1, shown in isolation for illustrative purposes.
Figure 8A:
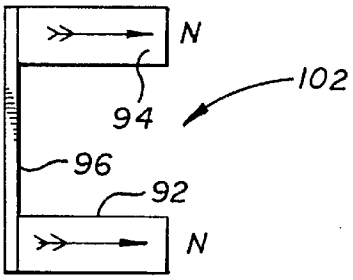
FIGS. 8*a* and 8*b* are top perspective views of the arrangement of FIG. 7 showing alternative polarity orientations of the magnets thereof.
Figure 8B:
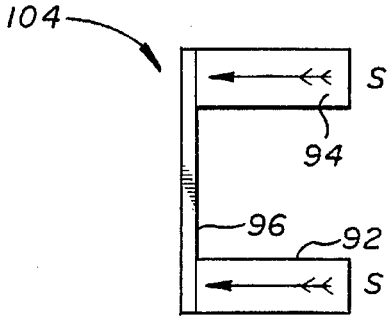
Figure 9:
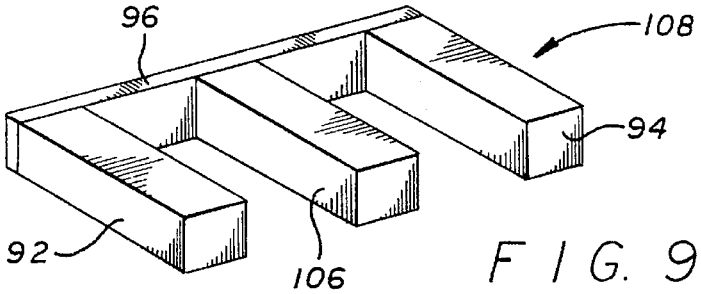
FIG. 9 is a perspective view, similar to FIG. 7, showing a first alternative actuator magnet arrangement.
Figure 10A:
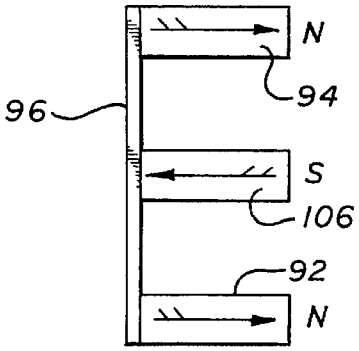
FIGS. 10*a* and 10*b* are top perspective views of the arrangement of FIG. 9, showing alternative polarity orientations of the magnets thereof.
Figure 10B:
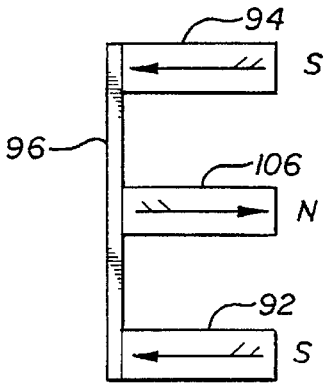
Figure 11:
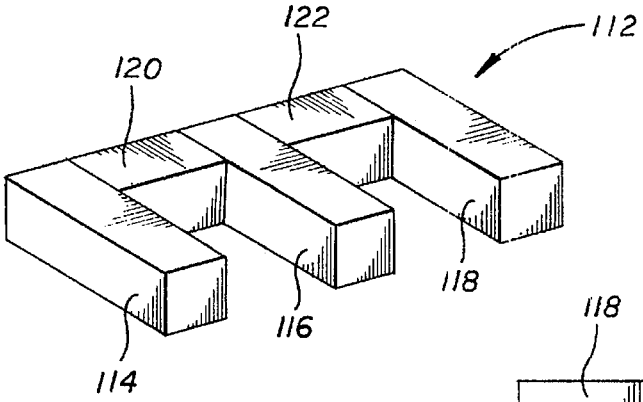
FIG. 11 is a perspective view; similar to FIG. 9, showing a second alternative actuator magnet arrangement.
Figure 12A:
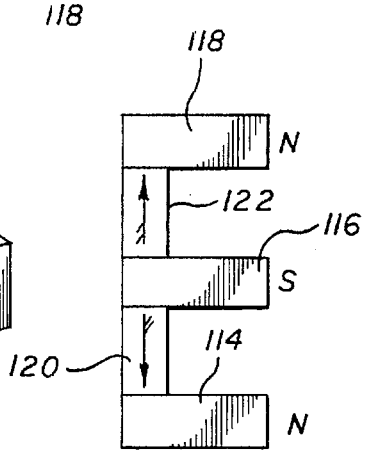
FIGS. 12*a* and 12*b* are top plan views of the arrangement of FIG. 11, showing alternative polarity orientations.
Figure 12B:
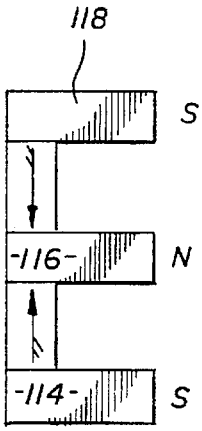

The two actuator magnets 92, 94 and the connector bar 96 are illustrated in isolation, apart from the actuator housing 80, in FIG. 7. FIG. 8*a* shows an embodiment generally at 102 with the free magnet ends being north poles and FIG. 8*b* generally at 104 shows them being south poles. An alternative actuator assembly embodiment is illustrated in FIG. 9 at 108 with a third magnet 106 spaced between the two outer magnets 92, 94, and having oppositely oriented poles therefrom as shown in FIGS. 10*a* and 10*b*. The third magnet 106 modifies the actuation distance of the actuator magnet assembly 52. An alternative to the FIG. 9 embodiment is shown generally at 112 in FIG. 11. Instead of providing three parallel magnets and a rear connector bar, three parallel metallic bars 114, 116, 118 and axially aligned, oppositely-oriented oriented magnets 120, 122 between them are used. The pole orientations selected for the magnets 120, 122 determine the resulting magnetic poles at the ends of the bars. While a north-south-north configuration of this invention is shown in FIG. 12*a*, an alternative south-north-south configuration is shown in FIG. 12*b*.

Figure 13:
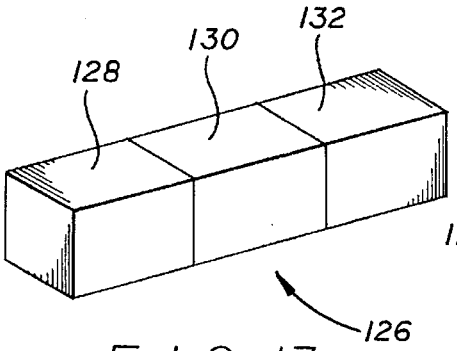
FIG. 13 is a perspective view, similar to FIGS. 7, 9 and 11, showing a third alternative actuator magnet arrangement.
Figure 14A:
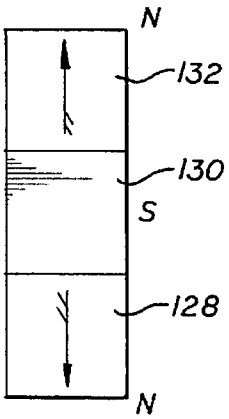
FIGS. 14*a* and 14*b* are top plan views of the arrangement of FIG. 13, showing alternative polarity orientations.
Figure 14B:
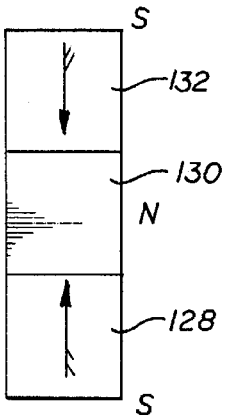

FIG. 13 illustrates another alternative actuator magnet arrangement generally at 126 with three blocks 128, 130, 132 axially aligned. The outer two blocks 128, 132 are magnetically-oppositely disposed magnets and a middle metallic connector bar 130 between them assumes a polarity the same as the adjacent magnets ends. Thus when viewed from the side, north-south-north (FIG. 14*a*) or south-north-south (FIG. 14*b*) poles result.

Figure 15:
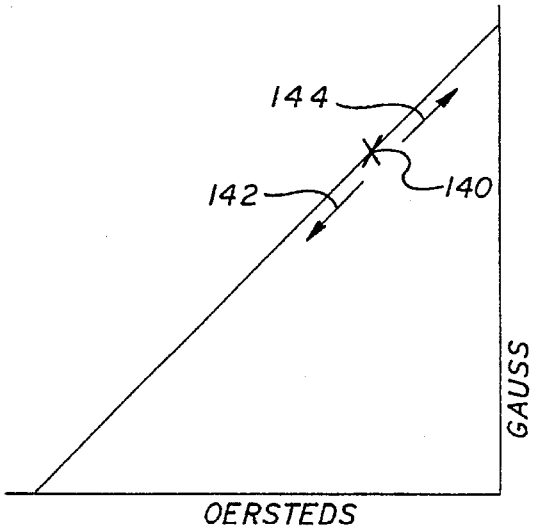
FIG. 15 is a graph showing the magnetic field versus the magnetic flux density and showing the relationship of the spacing between the stationary magnets of the stationary switch assembly of the system of FIG. 1.

FIG. 15 is a graph showing the magnetic field versus the magnetic flux density of the system of FIG. 1. It shows the relationship of the spacing between the stationary magnets 60, 62 of the stationary switch assembly 44. Referring thereto, if the biasing magnets get closer together, the operating point 140 moves towards small "D", down the curve; as shown by arrow 142. And as the magnets are moved away from each other, the point moves up the curve, as shown by arrow 144. This also affects how far the reed switches are from the bias magnets. The positioning and spacing of the bias magnets and then the reed switches are determined empirically.

Figure 16:
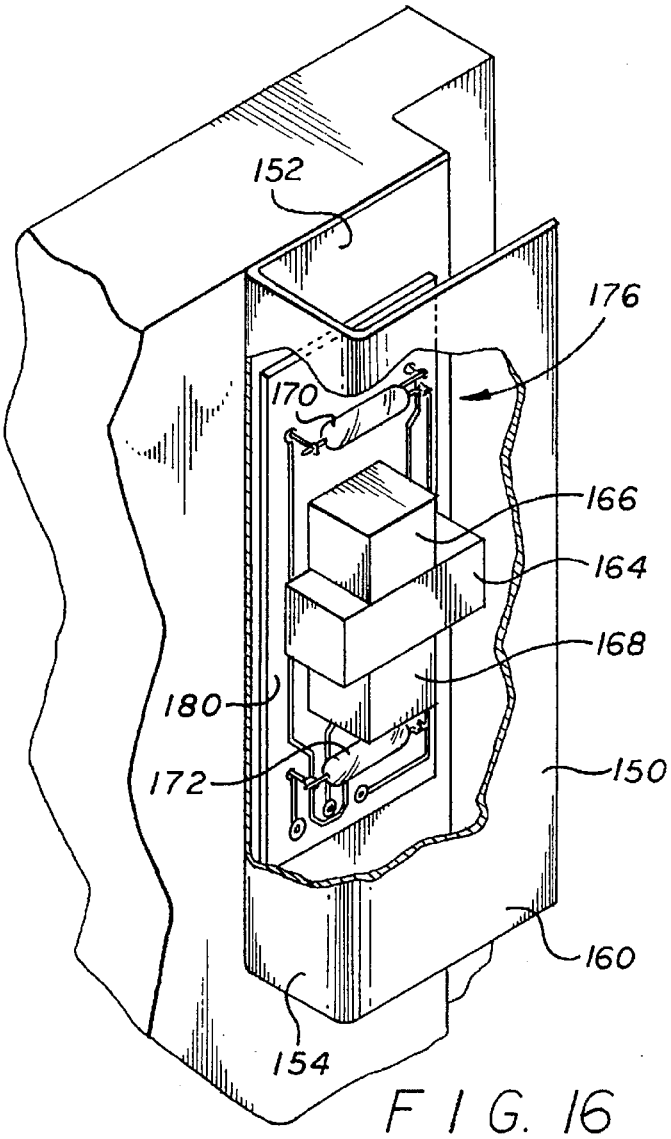
FIG. 16 is a perspective view of an alternative stationary switch assembly, shown mounted in a door frame and with portions thereof broken away for illustrative purposes.
Figure 17:
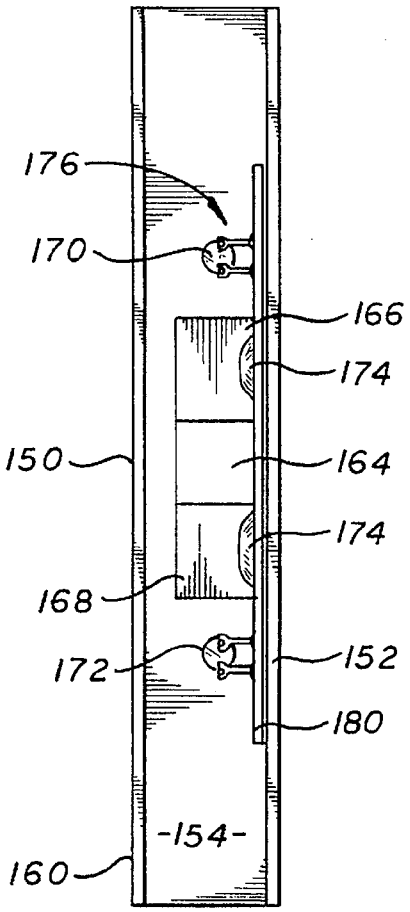
FIG. 17 is a side elevational view of the magnetic switch and shield of the assembly of FIG. 16.
Figure 18:
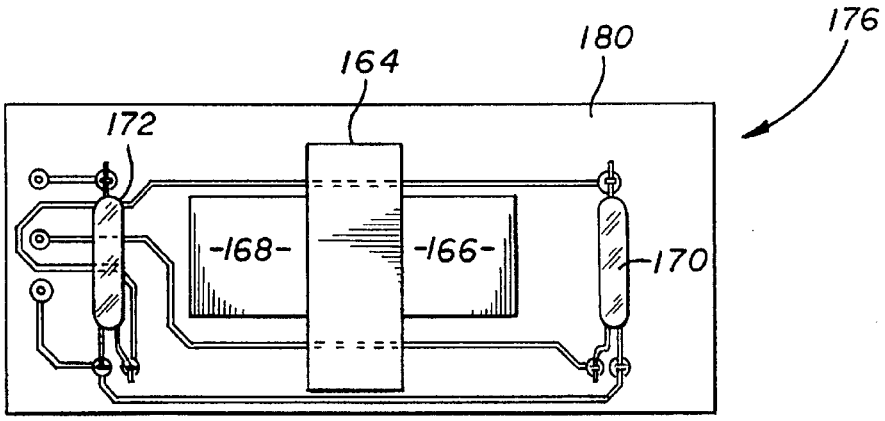
FIG. 18 is a top plan view of the switch of FIG. 17 illustrated in isolation.

Testing has shown that if the actuator magnets were brought in from the top (as shown in FIG. 18 or from the left side of FIG. 17) and rotated in the previously-discussed embodiment, it was possible that the switches could be actuated into the secure condition. The device could therefore be defeated by someone who possessed a second actuator. The second actuator is placed elsewhere on the switch module and the door of window may be freely opened without creating an alarm condition. Thus, pursuant to another preferred embodiment as shown in FIGS. 16 and 17, an iron or ferrous shield 150 is added on top to limit the angle of actuation. Also an iron or ferrous shield 152 can be added underneath so that the switch works without change on wooden doors. Additionally, a shield 154 can be used on the back so that a reversed-polarity actuator magnet cannot be brought in from the back side. These three shields are preferably formed as a U-shaped single-piece ferrous shield, as shown in FIGS. 16 and 17 at 160. With this combined U-shaped shield, the switch module will only read an actuator positioned in roughly the same plane as and to the right of the switch module as is shown in FIG. 16. The device can therefore not be defeated with a second actuator as the first actuator (attached to the door) occupies the only position in which an actuator can be read by the switch module. The shield 160 must have reasonable separation from the internal bias magnets or the interactive field will be distorted to a point where performance will be affected. The degree of separation can be determined empirically and depends on the values selected for the other components, but is generally on the order of 0.2 inch.

Another possible method of defeating the device is to introduce a single powerful magnet exactly in the center of the switch module. With careful positioning, it can cancel out both sides of the interactive field and release both reeds thereby putting the device into the secure condition. To prevent this, an iron or ferrous slug as shown in FIGS. 16–18 at 164 can be sandwiched between the switch magnets 166, 168 and parallel to the reed switches 170, 172. The slug 164 does not significantly change the interaction of and between the magnets, but it does magnetically short out the field of a single magnet coming in at the center.

FIG. 18 shows in isolation the switch plate generally at 176 with the two reed switches 170, 172, the two bias magnets 166, 168 and the perpendicular slug 164 therebetween all mounted with glue 174 on a printed circuit board 180. As shown in FIG. 17, the switch plate 176 can be mounted in the center of the shield 160. In one "tamper proof" embodiment though the switch plate 176 is off to the side so that an extra mechanical switch (not shown) can be inserted to one side of the switch plate.

The size and positioning of the bias magnets 166, 168 are first determined and designed without regard to the use of the slug 164. The slug 164 is then designed with a width equal to the gap distance between the magnets, a height equal to the height of the magnets, and a somewhat arbitrary length. The bias magnets 166, 168 of the. embodiment of FIGS. 16–18 may be shaped as cubes, cylinders or rectangular solids. Many different shapes and sizes can create a successful design depending on the type of magnet used and the actuation distance desired for the finished product. One of the benefits of the present invention is the ability to easily alter component selection and spacing to yield large changes in actuation distance and other characteristics of the finished product. Thus, the slug 164 prevents a single powerful foreign magnet introduced precisely into the center between the magnets from cancelling out or collapsing both lobe-shaped fields from the bias magnets 166, 168 and thereby deactivating the switches 170, 172. The slug 164 essentially absorbs the magnetic force of the foreign magnet.

The high or maximum security magnetic switch of this invention is intended to monitor the open or closed positions of doors, windows, machinery, safety barriers or other moveable assemblies in critical environments where an attempt to defeat the switch is a concern. The switch includes numerous design features that make it highly defeat resistant as discussed above and below. Additionally, the switch may be used indoors or outdoors. Two versions of the switch are contemplated by this invention to deal with different physical mounting conditions. Each version includes two components—the switch module 190 (or stationary switch assembly 44) and the magnet pack 192 (or actuator assembly 52). One version (FIG. 22) is intended primarily for use on doors and includes a jacketed cable 194 which can be hidden in the door frame. A second version (FIG. 23) provides a stainless steel jacketed cable 196 which is suitable for a range of applications where the cable cannot be hidden but still must resist possible attack.

A common approach used to defeat magnetic switches of the prior art is to introduce an external magnet near the switch module so that the door, window or other barrier can be opened without the switch alarming. The present invention cannot be defeated in this manner as its own magnet pack 192 (which contains a magnet array) must be used to put it into the secure state. If a very powerful external magnet is used in an attempt to defeat the system, it may even put the system into an alarm condition. Another method used to defeat prior art switches and which represents a more serious threat is when the person attempting to defeat the switch can obtain a second magnet pack the same as the one (192) in use. Then by positioning the second magnet pack near the switch module 190 in a certain manner, the door 200 can be opened without an alarm being signaled. The present design includes two defenses against this risk.

Figure 19:
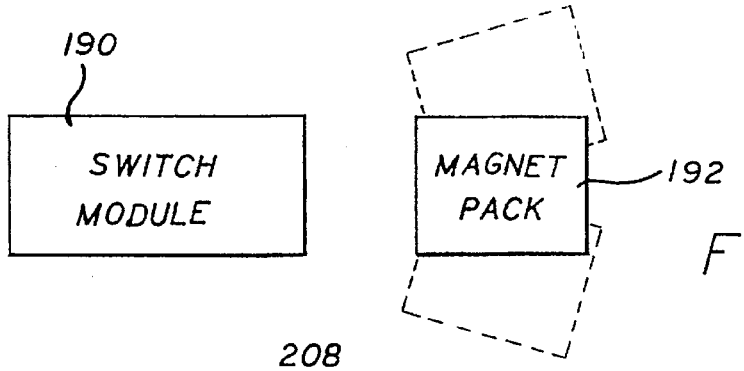
FIG. 19 is a schematic view showing a co-planar operation of the system of FIG. 1.

The first defense is referred to herein as the "coplanar operation" and is best illustrated in FIG. 19. The switch will only respond to the magnet pack 192 if the switch is located in roughly the same plane as the magnet pack. This is shown in FIG. 19 where the magnet pack 192 can only be read in a narrow range of approximately ten degrees in front of the switch module 190, as shown by the dotted lines, to enhance defeat resistance. A second magnet pack placed in proximity to the switch module 190 will not activate the switch because it will be offplane therefrom. In effect, there is only room for one magnet pack being read by the switch at a time so a second magnet pack cannot compromise security.

In certain physical situations, however, it may be possible to slowly open the door 200 and slowly introduce a second magnet pack. The present invention includes an extra defense against this. The product is manufactured in two completely different types, and the magnet pack 192 must be of the same type as the switch module 190 to work. This has been discussed above by providing alternative polarity orientations, and can best be understood by comparing FIG. 8*a* with FIG. 8*b*, FIG. 10*a* with FIG. 10*b*, FIG. 12*a* with FIG. 12*b* and/or FIG. 14*a* with FIG. 14*b*. That is, the present invention can be delivered as a matched pair with its type not marked in any way. Therefore, a person attempting the difficult task of trying to slowly open the door 200, while introducing a second magnet pack in an attempt to defeat the switch, may well have the wrong type pack. In a security application, the array of anti-defeat features of this invention will almost always result in the alarm sounding while the switch is being tampered with. This can lead to the person attempting to defeat the switch being identified and detained.

Another attack possibility is the actual removal of the switch module 190 which can serve several purposes. It can provide access to the cable (assuming the cable is hidden in the door frame). It can also be part of an attempt to remove both the switch module 190 and the magnet pack 192 as a unit which permits opening the door 200 or window without triggering an alarm. To forestall this, the present invention includes a novel hidden tamper switch feature. As discussed later, the tamper switch provides a two-wire output which is normally closed and opens if the switch is removed. This line can be separately monitored or connected in series with the main switch output.

Figure 20:
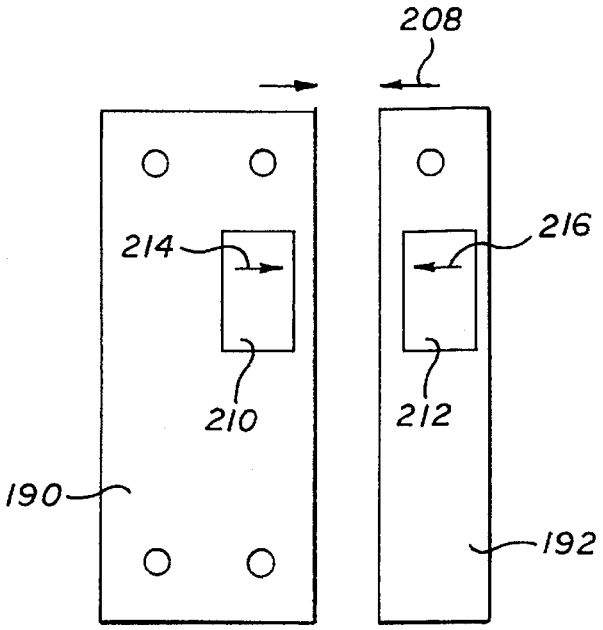
FIG. 20 is a view of the switch module and magnet pack of FIG. 19 for example, showing the relative positioning thereof.

The present invention can be used to monitor the opening of doors, windows, gates and barriers of all types. The switch module 190 is mounted on the part of the assembly that is fixed (such as a door frame or header 204) and the magnet pack 192 is mounted on the part of the assembly that moves (such as the door 200). Unlike many prior magnetic switches, the performance of the present system is unaffected by the type of surface on which it is mounted; that is, it will perform the same on steel as on wood. This is because the active parts of the switch module are already encircled by a steel case of sufficient thickness to magnetically shield these parts from the substrate. To install or mount the present system, the switch module 190 and the magnet pack 192 must be correctly oriented, must be roughly in the same plane and must be a defined distance 208 apart. To obtain a correct orientation, orientation arrows can be provided on labels 210, 212 on each component. This is shown, for example, in FIG. 20. The arrows 214, 216, if provided on the labels, directly face each other and the ends of the two components must be even, that is not offset from each other. The system includes a minimum and a maximum operating distance, and will report "secure" only when the separation (or "actuation") distance 208 is between these maximum and minimum distances. If the magnet pack 192 is too close to the switch module 190 or too far away, the unit will alarm. The distance between the minimum and maximum separation points is called the "gap. " The present system can provide a gap on the order of 0.4 to 0.5 inch or 10.0 to 12.5 mm. For best reliability, the actual separation distance 208 should be set exactly midway in this gap. The gap, however, will vary somewhat on each trait and the minimum distance at which the gap starts will also vary. The optimum midway separation distance can also be determined using a ruler and Ohmmeter, but a preferred method is to have this distance checked by the manufacturer at the factory and printed on the switch module label 210 and then this printed separation distance used when mounting the unit.

Figure 21:
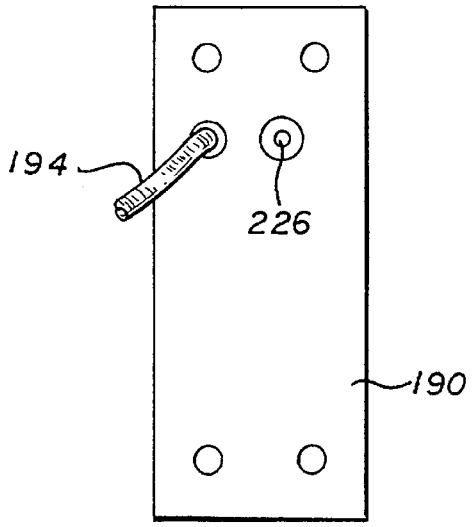
FIG. 21 is a rear view of the switch module of FIG. 20.
Figure 22:
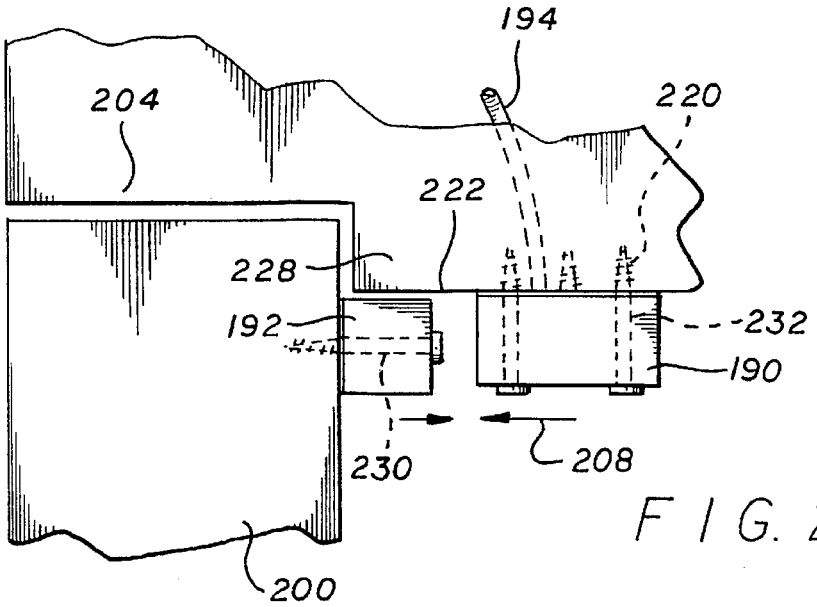
FIG. 22 is an elevational view showing a hidden tamper-switch mounting arrangement of the system of FIG. 19, for example, on an outswinging door.
Figure 22A:
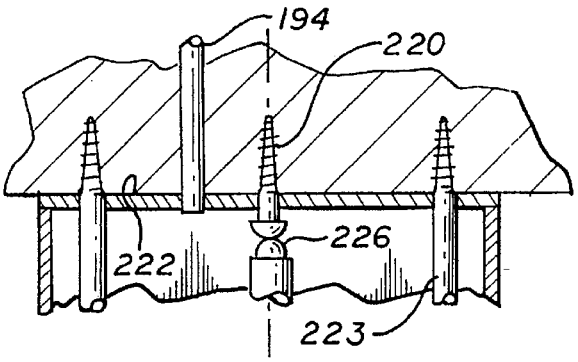
FIG. 22*a* is an enlarged cross-sectional view through the mounted switch module of FIG. 22, showing the tamper switch in greater detail.
Figure 23:
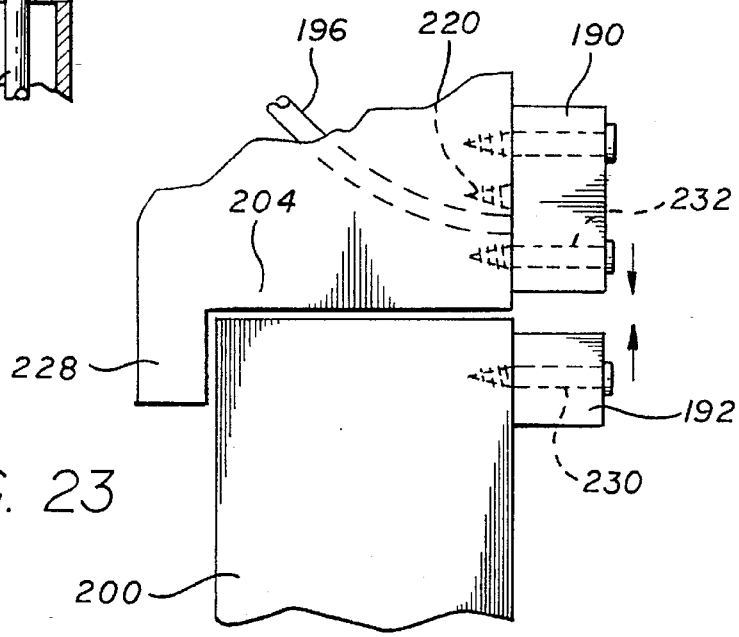
FIG. 23 is a view similar to FIG. 22, showing a hidden tamper-switch mounting arrangement of the present invention on an inswinging door.
Figure 24:
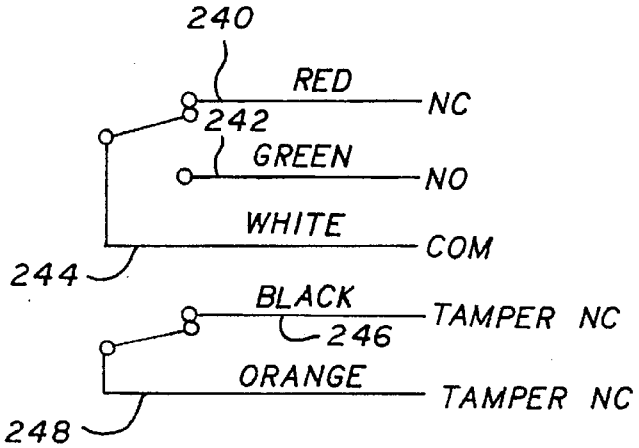
FIGS. 24 and 25 are circuit diagrams for the system(s) of FIGS. 22 and 23.
Figure 25:
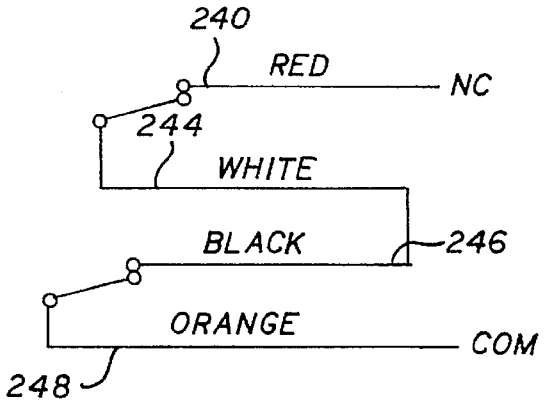

The present invention can also include a tamper feature as mentioned above and which works as described below. A round head screw 220 is set into the surface 222 which is to receive the switch module 190, as shown in FIGS. 22 and 23. A template (not shown) can be used to show the positioning of this screw 220. When the switch module 190 is installed, the tamper screw 220 depresses, as shown in FIG. 22*a*, the tamper switch 226 (plunger end of a mechanical switch) which is shown in FIG. 21. The tamper screw is needed to depress and activate the tamper switch as it is positioned within the switch module such that the end of the plunger is flush with the bottom edge of the switch module. The two-wire output of the tamper switch is not interconnected to the three-wire output of the reed switches and, therefore constitutes a separate alarm circuit. The fact that the switch module 190 is tamperproof is undetectable, because the tamper switch and the screw that depresses it are both hidden beneath the body of the switch module after mounting. And any attempt to remove the switch module 190 will open the tamper circuit, as shown in FIGS. 24 and 25. An attempt to clear under the switch module 190 with a saw (not shown), for example, in order to overcome the tamper protection as is possible with prior art designs will not work with the present design. This is because the saw will cut the head of the tamper screw 220, but then when the switch module body is lifted away from the substrate the force of the spring in the tamper switch 226 causes the switch to open signalling a tamper violation. This circuit may be directly monitored or connected in series with the closed loop of the main switch output such that a tamper violation will create the same alarm signal as if the door 200 were opened.

The first version mentioned above with the long jacketed cable 194 is intended for a protected and unobtrusive installation on outswinging doors. FIG. 22 shows a preferred configuration thereof, and door stop 228 is illustrated therein. The magnet pack 192 is first mounted on the door 200, using the magnet packs two sets of screw holes (see FIG. 20). The magnet pack position is selected so that the arrow 216 on its label 212 is pointing towards the switch module 190. The label 212 is preferably positioned on the bottom of the pack, that is facing the floor. The pilot holes for the mounting screws 230 are then drilled. They are positioned such that the magnet pack 192 when mounted is not dropped below the door stop 228 by more than one-eighth inch since it has to be roughly in the same plane as the switch module 190 to function. The switch module 190 is next mounted. The leading edge of the switch module 190 is set to match the separation distance 208 printed on the label 210. The switch label arrow 214 must point at the magnet pack arrow 216. Using a template (not shown), small holes are drilled for the mounting screws 232 and a larger hole is drilled for the cable 194 which will be concealed in the door frame. If the tamper feature of the switch is to be used, another small hole for the tamper screw 220 is drilled, again following the template. This installation technique produces an attractive and high security result. The physical projection into the door opening is at a minimum and it is hard to tamper with the installation. Unlike prior art products, the magnet pack 192 cannot be removed without opening the door 200 which will signal an alarm and, of course, the switch module 190 has its own tamper switch 226.

The present system is generally mounted on the inswinging side of a door 200 when that side represents a protected area. FIG. 23 is a cross-section of this configuration and shows the unit mounted on the top of the door 200, but the unit of course can be mounted on the side, if desired. The magnet pack 192 is first mounted on the door 200, using the magnet pack's two sets of screw holes. The magnet pack 192 position is selected so that the arrow 216 on its label 212 points towards the switch module 190. The label 210 is facing away from the door 200 as shown in FIG. 23. The magnet pack 192 should then be mounted as shown, and pilot holes are drilled for the mounting screws 230. The switch module 190 is then mounted. The leading edge of the switch module 190 is set to match the distance 208 printed on the label 212. The switch label arrow points 214 at the magnet pack arrow 216, and using the template, holes are drilled for the mounting screws 230 and a larger hole for the cable 196 which will be concealed in the door frame. If the tamper feature of the switch module 190 is to be used, a small hole is drilled for the tamper screw 220, again following the template. This installation technique produces an attractive and high security result. A benefit of an inswinging door installation is that when the door 200 opens it sweeps out the area under the switch module 190. Therefore, someone trying to defeat the switch with a second magnet pack (not shown) will be unable to position the second magnet pack in the coplaner reading position because of the movement of the door 200. The unique positioning of mounting holes arid cable exit of the present invention when installed on both outswinging and inswinging doors, which constitute a large percentage of potential applications, provides a novel defense against defeating the unit by removal of the magnet pack.

In some situations it is not possible to conceal the cable, so the second version mentioned above includes a stainless steel jacket on its cable 196 to provide protection. With this version, the cable 196 emerges from the end of the switch module 190 which is necessary for running the cable on the Surface. Numerous physical mounting methods can be used so long as the magnet pack 192 and switch module 190 are in the same plane, separated by the correct distance and the arrows 214, 216 on the labels 210, 212 face each other.

The system as shown generally has five wires, and they can each be assigned a separate color (or other identifier). As an example and referring to FIG. 24: White (240)=Common; Red (242)=NC; Green (244)=NO; Orange (246)=Tamper NC; and Black (248)=Tamper NC. For purposes of this description, the "normal" condition of the system is when it is reporting "secure"; that is, the magnet pack 192 is at the separation distance from the switch module 190. Thus, for example, a closed circuit between White wire 240 and Green wire 244 will be read if one switch module is in alarm condition (the magnet is not near the switch module), but it will read "open" if one meters it in the "secure" condition. The Orange wire 246 and Black tamper wires 246, 248, respectively will be closed when the tamper switch 226 is in a "secure" condition (depressed by the tamper screw 220) and opened if the tamper switch is displayed (alarm condition).

FIG. 24 is a schematic showing the switch in a secure condition with the tamper feature in use. The contacts will switch when the switch alarms or the tamper is violated. Separate connection of the main switch output and the tamper output requires two alarm points. Generally, the switch output is connected to a point which is subject to arming and disarming depending on the time of day. The tamper contacts are connected to a twenty-four hour point to raise an alarm any time the switch module is tampered with.

If two alarm points are not available because of wire count limitations, the tamper output can be wired in series with the switch's NC loop. Referring to FIG. 25, with this connection, the circuit Will open creating an alarm condition if either the door 200 opens or the switch module 190 is tampered with while the door is closed. A preferred embodiment includes the contact ratings having a maximum of two hundred and fifty mA at a maximum of thirty volts at a switch module SPDT output and a maximum of one amp at a maximum of thirty volts for the tamper circuit.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A balanced-type, magnetically-actuated proximity switch system, comprising:

a magnetic switch assembly mountable to a first structure, said magnetic switch assembly including (1) first and second switch magnets fixed in relative position wherein they are axially aligned and wherein adjacent ends thereof have the same polarity, and (2) first and second reed switches positioned on opposite outside ends of respective said first and second switch magnets and generally perpendicular to an axial magnet alignment and both operatively connectable to an electric circuit; and an actuator magnet assembly mountable to a second structure which is movable between open and closed positions relative to the first structure;

wherein said first and second reed switches, when the second structure is in the open position, are in a first condition relative to the electrical circuit indicating the open position, due to the magnetic influence of said first and second switch magnets thereon; and wherein said first and second reed switches, when the second structure is in the closed position, are in a second condition relative to the electrical circuit indicating the closed position, due to the magnetic influence of said actuator magnet assembly thereon.

2. The system of claim 1 wherein said magnetic switch assembly includes a ferrous slug extending perpendicular to and sandwiched directly between said first and second switch magnets.

3. The system of claim 2 further comprising a shield supported by the first structure and enclosing said magnetic switch assembly on three sides thereof.

4. The system of claim 3 wherein said magnetic switch assembly includes a printed circuit board on which said switch magnets, said slug, and said reed switches are mounted, said circuit board being mounted in said shield.

5. The system of claim 1 wherein the electric circuit comprises a security system.

6. The system of claim 1 wherein the electric circuit comprises a control system.

7. The system of claim 1 wherein the electrical circuit comprises a control unit, said first and second switches when in the first condition are both open and said control unit is thereby unactuated, and said first and second switches when in the second condition are both closed and said control unit is thereby actuated.

8. The system of claim 1 wherein said actuator magnet assembly includes first and second actuator magnets fixed parallel to and spaced from one another.

9. A balanced-type, magnetically-actuated proximity switch system, comprising:

a magnetic switch assembly mountable to a first structure, said magnetic switch assembly including (1) first and second switch magnets affixed relative to one another such that the magnetic repulsive forces between them create a resultant interactive magnetic field, and (2) first and second magnetically-actuatable switches mounted relative to said first and second magnets and in the interactive magnetic field and operatively connectable to an electrical circuit; and an actuator magnet assembly mountable to a second structure which is movable between open and closed positions relative to the first structure, said actuator magnet assembly including first and second actuator magnets;

wherein when the second structure is in the open position, the interactive magnetic field causes said first and second switches to assume a first condition relative to the electrical circuit to indicate the open position; and wherein when the second structure is in the closed position, said first and second actuator magnets act together on the interactive magnetic field to thereby cause said first and second switches to both assume a second condition relative to the electrical circuit to indicate the closed position.

10. The system of claim 9 wherein said magnetic switch assembly includes a ferrous slug extending perpendicular to and sandwiched directly between said first and second switch magnets.

11. The system of claim 10 further comprising a shield supported by the first structure and enclosing said magnetic switch assembly on three sides thereof.

12. The system of claim 10 wherein said actuator magnet assembly includes magnet means between said first and second actuator magnets for modifying an actuation distance of said actuator magnet assembly relative to said magnetic switch assembly.

13. The system of claim 9 wherein said first and second actuator magnets are disposed parallel to one another and with their north pole ends pointing in the same direction.

14. The system of claim 13 wherein said actuator magnet assembly includes a third actuator magnet between and oriented parallel to said first and second actuator magnets and with its north pole end pointing in a direction opposite to the same direction.

15. A balanced-type, magnetically-actuated proximity switch system, comprising:

a magnetic switch assembly mountable to a first structure;

a magnetic actuator assembly mountable to a second structure which is movable between open and closed positions relative to the first structure;

wherein said switch assembly includes a plurality of permanent biasing magnets arranged with opposing polarity orientations so as to produce a resultant interactive magnetic switch field, said switch field producing a plurality of switch field apparent poles;

wherein said switch assembly includes a plurality of electrically-interconnected magnet reed switches, each said switch being biased to a magnetically actuated state by the interactive magnetic switch field;

wherein said actuator assembly includes a plurality of permanent actuator magnets arranged to produce a plurality of actuator field apparent poles;

wherein the number of said actuator field apparent poles is the same as the number of said switch field apparent poles;

wherein when the second structure is in the closed position, said actuator field apparent poles alter the switch field thereby overcoming the actuating effect of the switch field on said switches; and wherein the number of said switch field poles is an odd number such that said magnetic switch assembly cannot be deceived using only a single permanent foreign magnet.

16. The system of claim 15 wherein said magnetic switch assembly includes a ferrous slug extending perpendicular to and sandwiched directly between two of said permanent biasing magnets.

17. The system of claim 16 further comprising a shield supported by the first structure and enclosing said magnetic switch assembly on three sides thereof.

18. For a balanced-type, magnetically-actuated proximity switch system, a stationary switch assembly comprising:

first and second high coercivity magnets;

mounting means for mounting said magnets in place such that their poles are in opposition and such that said magnets are fixed in position relative to one another to thereby form an interactive magnetic field; and first and second reed switches connectable to a central unit, and mounted relative to said magnets such that the interactive magnetic field biases both said switches to inactive conditions and such that a single external magnet alone is unable to bring both said switches to simultaneous active conditions to thereby defeat the central unit.

19. The assembly of claim 18 wherein the central unit is a control or security system.

20. The assembly of claim 18 wherein said first and second reed switches are arranged as a single-pole double-throw switching assembly.

21. The assembly of claim 18 further comprising a ferrous slug extending perpendicular to and sandwiched directly between said first and second magnets.

22. The assembly of claim 18 wherein the high coercivity is between 2,000 and 30,000 Oersteds.

23. For a balanced-type, magnetically-actuated proximity switch system, a stationary switch assembly comprising:

first and second high-coercivity permanent switch magnets fixed substantially in line with their poles in opposition and with a gap between adjacent ends thereof, both said magnets having substantially the same length, the gap being generally equivalent to each of the magnet lengths, and the lengths being generally equivalent to the diameters of the faces of said magnets, said first and second magnets creating an interactive resultant magnetic field; and first and second reed switches operatively connectable to a control system and affixed relative to said first and second switches magnets such then said reed switches are in non-activated conditions, the control system is in a non-actuated state, and when said reed switches are in actuated conditions by the close proximity thereto of an actuator magnet assembly, the control system is in an actuated state.

24. The assembly of claim 23 wherein said first and second reed switches define a single-pole double-throw switching assembly.

25. The assembly of claim 23 wherein the high coercivity is between 2,000 and 30,000 Oersteds.

26. A balanced-type, magnetically-actuated proximity switch system, comprising:

a magnetic switch assembly mountable to a first structure, said magnetic switch assembly including (1) first and second switch magnets affixed relative to one another such that the magnetic repulsive forces between them create a resultant interactive magnetic field having first and second lobes, (2) magnetically-actuatable switch means mounted relative to said first and second magnets and in the interactive magnetic field and operatively connectable to an electrical circuit, and (3) a ferrous slug extending perpendicularly to and sandwiched directly between said first and second switch magnets to cancel a single foreign magnet introduced along a line between said first and second switch magnets;

an actuator magnetic assembly mountable to a second structure which is movable between first and second positions relative to the first structure;

wherein when the second structure is in the first position, the interactive magnetic field causes said switch means to assume a first condition relative to the electrical circuit to indicate the first position; and wherein when the second structure is generally in the second position, said actuator magnetic assembly acts on the interactive magnetic field to thereby cause said switch means to assume a second condition relative to the electrical circuit to indicate the closed position.

27. The system of claim 26 further comprising a U-shaped ferrous shield supported by the first structure, enclosing said magnetic switch assembly on three sides thereof and having an open side out through which a longitudinal axis of said ferrous slug passes.

28. The system of claim 27 wherein said magnetic switch assembly includes a circuit board to which said switch magnets, said slug and said switch means are mounted, and said circuit board is positioned in said U-shaped shield.

29. The system of claim 26 wherein said switch means includes first and second reed switches.

30. A balanced-type, magnetically-actuated proximity switch system, comprising:

a magnetic switch assembly including magnet means for defining a magnetic field and switch means positioned in the magnetic field and operatively connectable to an electrical circuit, said magnetic switch assembly being mountable to a first structure;

a U-shaped ferrous shield enclosing said magnetic switch assembly on three sides thereof, supportable by the first structure and having an open fourth side;

an actuator magnet assembly mountable to a second structure which is movable between first and second positions relative to the first structure;

wherein when the second structure is in the first position, the magnetic field causes said switch means to assume a first condition relative to the electrical circuit to indicate the first position; and wherein when the second structure is in the second position, said actuator magnet assembly acts through said open side on the magnetic field to cause said switch means to assume a second condition relative to the electrical circuit to indicate the second position.

31. The system of claim 30 wherein said magnet means includes a pair of parallel magnets and said switch means includes a pair of reed switches.

32. The system of claim 31 wherein Raid magnetic switch assembly includes a circuit board disposed in said U-shaped shield and on which said parallel magnets and said reed switches are mounted.

33. The system of claim 30 wherein said U-shaped shield is open at both ends thereof.

34. The system of claim 30 wherein said open fourth side faces said actuator magnet assembly with the second structure in the second position.

35. A magnetically-actuated proximity switch system, comprising:

(1) a first switch system including:

(a) a first magnetic switch assembly mountable to a first structure, said first magnetic switch assembly including a first switch means and first switch magnet means for producing a first switch pole arrangement; and (b) a first magnetic actuator assembly mountable to a second structure, said first magnetic actuator assembly including first actuator magnetic means for producing a first actuator pole arrangement;

wherein the first actuator pole arrangement is in magnetic opposition to the first switch pole arrangement such that when the first and second structures are moved between distant and proximate positions relative to one another a switch actuation condition of said first switch means is changed; and (2) a second switch system including:

(a) a second magnetic switch assembly mountable to a third structure, said second magnetic switch assembly including a second switch means and second switch magnet means for producing a second switch pole arrangement; and (b) a second magnetic actuator assembly mountable to a fourth structure, said second magnetic actuator assembly including second actuator magnet means for producing a second actuator pole arrangement;

wherein the second actuator pole arrangement is in magnetic opposition to the second switch pole arrangement such that when the third and fourth structures are moved between distant and proximate positions relative to one another a switch actuation condition of said second switch means is changed; and wherein the second actuator pole arrangement is the opposite of the first actuator pole arrangement such that said second magnetic actuator assembly cannot deactivate said first magnetic switch assembly; and wherein each of the pole arrangements includes a plurality of apparent poles formed by interactive fields of said first and second switch magnet means, respectively.

36. The system of claim 35 wherein said first and second switch means both comprise single-pole double-throw switching assemblies.

37. The system of claim 35 wherein the first switch pole arrangement comprises a north-south-north apparent pole arrangement and the second switch pole arrangement comprises a south-north-south apparent pole arrangement.

38. The system of claim 35 wherein the first and third structures are both fixed stationary structures.

39. The system of claim 35 wherein said first magnetic actuator means includes a pair of parallel actuator magnets having both their north poles being disposed towards said first switch magnet means and said second magnetic actuator means includes a pair of parallel actuator magnets having both their south poles being disposed towards said second switch magnet means.

40. The system of claim 35 wherein said first and second magnetic actuator assemblies are essentially identical except for the first and second actuator pole arrangements being opposite.

41. A balanced-type, magnetically actuated proximity switch system, comprising:

a magnetic switch assembly including a case, magnet means and switch means, both said magnet means and said switch means being positioned in said case, said case being mountable to a surface of a first structure;

a magnetic actuator assembly mountable to a second structure which is moveable between first and second positions relative to the first structure and positioned relative to said magnetic switch assembly to alter the actuation condition of said switch means when the second structure is moved between the first and second positions; and a tamper indicator assembly including (a) a mechanical push switch having a plunger whose end does not extend beyond a back plane of said case and (b) a member having an end and insertable into the surface such that said end is exposed, said plunger being exposed at a back of said case such that with said back mounted to the surface of the first structure, said member end pushes against and operatively engages said plunger and such that in a tamper event when said member end no longer operatively pushes against said plunger an alarm is actuated.

42. The system of claim 41 wherein said member is a screw.

43. The system of claim 41 wherein said case is mounted to the surface with mounting screws.

44. The system of claim 41 further comprising a cable connecting said switch means with a control unit and extending out through an opening in said case.

45. The system of claim 44 wherein said cable comprises a stainless steel jacketed cable.

46. The system of claim 44 wherein the second structure is an outswinging door and said cable is a jacketed cable.

47. A balanced-type, magnetically-actuated proximity switch system, comprising:

a barrier frame;

an outswinging barrier which swings relative to said barrier frame between a closed position and an outswung open position;

a magnet pack;

a first elongate fastener extending in a first direction and securing said magnet pack to said outswinging barrier;

a magnetically-actuable switch module;

a second elongate fastener extending in a second direction perpendicular to the first direction and securing said switch module to said barrier frame; and a cable extending from said switch module into said barrier frame and operatively to an alarm system;

wherein with said outswinging barrier in the closed position, said magnet pack and said switch module are proximate one another and oriented such that said magnet pack magnetically actuates said switch module to a first switch condition, and with said outswinging door swung from the closed position out to the open position, the relative positioning of said magnet pack and said switch module assumes a second switch condition causing the alarm system to actuate.

48. The system of claim 47 wherein said outswinging barrier comprises an outswinging door.

49. The system of claim 47 wherein the first direction is horizontal.

50. The system of claim 49 wherein the second direction is vertical.

51. The system of claim 47 wherein the first and second elongate fasteners both comprise screws.

52. The system of claim 47 wherein said magnet pack and said switch module face each other along the first direction.

53. The system of claim 47 wherein (1) said switch module includes a rear face with an opening, and a tamper switch having a plunger end accessible through said opening and which does not extend beyond said rear face, and (2) said barrier frame includes a protruding element positioned such that with said switch module secured to said barrier frame said element extends into said opening and pushes against said plunger end to thereby deactivate said tamper switch and with said switch module removed a distance from its securement to said barrier frame said element no longer pushes sufficiently against said plunger end and said tamper switch is thereby activated.

54. The system of claim 53 wherein said tamper switch is operatively connected to the alarm system such that when said tamper switch is activated the alarm system is actuated.

55. The system of claim 53 wherein said element comprises a round-headed screw.

56. The system of claim 47 wherein said switch module includes a U-shaped ferrous shield and a magnetically-actuatable switch mounted in said U-shaped ferrous shield, said U-shaped ferrous shield being enclosed on three sides thereof and having a fourth open side, said open side facing said magnet pack with said barrier in the closed position.

57. The system of claim 56 wherein said switch defines a first switch, and said switch module includes a magnetically-actuable second switch, a first switch magnet and a second switch magnet, all within said U-shaped ferrous shield.

58. The system of claim 57 wherein said first and second switch magnets form an interactive magnetic field which causes said first and second switches to assume a switch first condition with said magnet pack in a first relative position and a switch second condition with said magnet pack in a second relative position and altering the magnetic field.

59. The system of claim 47 wherein said magnet pack includes an array of actuator magnets.

60. The system of claim 47 wherein a longitudinal axis of said first elongate fastener passes through said switch module and said switch module and said magnet pack are separated from one another with said outswinging barrier in the closed position by only about one-half inch.

61. A magnetically-actuated proximity switch system, comprising:

(1) a first switch system including:

(a) a first magnetic switch assembly mountable to a first structure; said first magnetic switch assembly including a first switch means and first switch magnet means for producing a first switch pole arrangement; and (b) a first magnetic actuator assembly mountable to a second structure, said first magnetic actuator assembly including first actuator magnetic means for producing a first actuator pole arrangement;

wherein the first actuator pole arrangement is in magnetic opposition to the first switch pole arrangement such that when the first and second structures are moved between distant and proximate positions relative to one another, a switch actuation condition of said fast switch means is changed;

(2) a second switch system including:

(a) a second magnetic switch assembly mountable to a third structure, said second magnetic switch assembly including a second switch means and second switch magnet means for producing a second switch pole arrangement; and (b) a second magnetic actuator assembly mountable to a fourth structure, said second magnetic actuator assembly including second actuator magnet means for producing a second actuator pole arrangement;

wherein the second actuator pole arrangement is in magnetic opposition to the second switch pole arrangement such that when the third and fourth structures are moved between distant and proximate positions relative to one another, a switch actuation condition of said second switch means is changed; and wherein the second actuator pole arrangement is the opposite of the first actuator pole arrangement such that said second magnetic actuator assembly cannot deactivate said first magnetic switch assembly; and wherein the first switch pole arrangement comprises a north-south-north apparent pole arrangement and the second switch pole arrangement comprises a south-north-south apparent pole arrangement.

62. The system of claim 61 wherein said first and second switch means both comprise single-pole double-throw switching assemblies.

63. The system of claim 61 wherein the first and third structures are both fixed stationary structures.

64. The system of claim 61 wherein said first magnetic actuator means includes a pair of parallel actuator magnets having both their north poles being disposed towards said first switch magnet means and said second magnetic actuator means includes a pair of parallel actuator magnets having both their south poles being disposed towards said second switch magnet means.

65. The system of claim 61 wherein said first and second magnetic actuator assemblies are essentially identical except for the first and second actuator pole arrangements being opposite.

* * * * *